United States Patent [19]

Takagi

[11] 4,314,854

[45] Feb. 9, 1982

[54] METHOD FOR THE TREATMENT OF CELLULOSIC SUBSTANCES WITH HYDROGEN PEROXIDE

[75] Inventor: Motoyoshi Takagi, Toda, Japan

[73] Assignee: Bio Research Center Company Ltd., Saitama, Japan

[21] Appl. No.: 240,713

[22] Filed: Mar. 5, 1981

[30] Foreign Application Priority Data

Oct. 3, 1980 [JP] Japan ..... 55-30109

[51] Int. Cl.[3] ..... C13K 1/02

[52] U.S. Cl. ..... 127/37; 162/78; 435/99

[58] Field of Search ..... 127/37; 162/78; 435/99

[56] References Cited

U.S. PATENT DOCUMENTS

| | | | |
|---|---|---|---|
| 2,284,500 | 5/1942 | Warth | 127/37 |
| 2,368,527 | 1/1945 | Edelstein | 162/78 X |
| 2,777,749 | 1/1957 | Young | 162/78 X |
| 3,156,654 | 11/1964 | Konecny | 162/78 X |
| 3,972,775 | 8/1976 | Wilke | 435/99 |
| 3,990,945 | 11/1976 | Huff | 435/99 |
| 4,029,543 | 6/1977 | Lindahl | 162/78 X |
| 4,089,745 | 5/1978 | Antrim | 435/99 |
| 4,105,467 | 8/1978 | Buckl | 127/37 |
| 4,160,693 | 7/1979 | Lindahl | 162/78 X |
| 4,222,819 | 9/1980 | Fossum | 162/78 X |
| 4,237,226 | 12/1980 | Grethlein | 435/99 |
| 4,265,675 | 5/1981 | Tsao | 127/37 |
| 4,281,063 | 7/1981 | Tsao | 435/99 |

OTHER PUBLICATIONS

D. Lachenal et al., Tappi, 63 (11), pp. 59–62 (1980).
Chemical Abstracts, 71:82463f (1969).

*Primary Examiner*—Sidney Marantz
*Attorney, Agent, or Firm*—D. R. Cassady

[57] ABSTRACT

A method to enhance the reactivity of cellulose-containing materials to cellulase enzymes by treating an aqueous suspension of the material with hydrogen peroxide in the presence of a $Mn^{+2}$ ion forming manganese compound.

4 Claims, No Drawings

METHOD FOR THE TREATMENT OF CELLULOSIC SUBSTANCES WITH HYDROGEN PEROXIDE

BACKGROUND OF THE INVENTION

Recent interest in the industrial manufacture of ethanol and other organic chemicals from saccharides and poly-saccharides has lead to the utilization of surplus grain as a source of these chemicals by enzyme-fungal or bacterial conversion of the sugars contained therein. The starting grain is, however, in the food chain and its diversion for other uses is arguably not in the best interests of society. Ghose, U.S. Pat. No. 3,642,580, Mandels and Kostick, U.S. Pat. No. 3,764,475, and Gauss et al., U.S. Pat. No. 3,990,944 have disclosed processes whereby cellulose can be enzymatically converted to simple sugars and thence to ethanol.

The key to this conversion has been to free native cellulose from the lignin intimately bound thereto and to expand the cellulose structure to allow accessibility of the solid to the enzyme needed for conversion.

In order to improve the reactivity of cellulose to hydrolysis to obtain sugars, pretreatment of materials containing cellulose with caustic soda, ammonia, peracetic acid or hydrogen peroxide prior to the hydrolysis has been proposed. Attempts to parallel the hydrolysis procedure to that of starchs have not been successful since cellulose is a difficult material to hydrolyze compared with starch, so pretreatment using the above mentioned substances is considered very important before hydrolyzing cellulose-containing materials.

However, pretreatment by alkali or acid as described above is accompanied by problems in recovery or disposal of waste alkali or waste acid. In addition, corrosion of the equipment used for the pretreatment inevitably occurs. When hydrogen peroxide is used for pretreatment the disposal and corrosion problems are minimized, but drawbacks are that hydrogen peroxide costs more than alkali or acid and a greater amount is needed for the effective pretreatment. Furthermore, hydrogen peroxide does not more substantially enhance the susceptibility of cellulose to enzymic attack than do alkali or acid, so it has not yet been put into practical use.

It is known that various metal salts such as salts of $Fe^{++}$ (Fenton reagent), $Cu^{+}$, $Cu^{++}$, $Co^{++}$ or other metal compounds such as $V_2O_5$, $OsO_4$, $WO_3$, $MoO_3$, $SeO_2$, $TiCl_4$, and $CrO_3$ are used with hydrogen peroxide to bleach fibrous materials such as cotton, linen and pulp. However, use of the above metal compounds and especially manganese compounds together with hydrogen peroxide for the improvement of hydrolysis of cellulose by enzyme has not been reported.

SUMMARY OF THE DISCLOSURE

This invention concerns a method of treatment of cellulosic materials to improve susceptibility to enzymatic saccharification. More specifically, this invention relates to the method of pretreatment of cellulosic materials with hydrogen peroxide in the presence of manganese salts which form manganous ion in solution to cause a remarkable improvement in the hydrolysis reactivity.

DETAILED DESCRIPTION OF THE INVENTION

The characteristic of this invention is the treatment of cellulosic materials with hydrogen peroxide in the presence of manganese compounds.

Cellulosic materials to be treated by the method of this invention include agricultural products such as wood, wood chips, rice straw, rice hulls, bagasse, corn stalks and corn cobs; newspaper, corrugated cardboard, waste paper, pulp waste and cellulosic materials contained in municipal and industrial wastes. It is desirable to pulverize or disintegrate these materials depending on their forms prior to the treatment.

The manganese compounds used with hydrogen peroxide in this invention are salts, oxides or complex salts which produce $Mn^{+2}$ ion, for example, $MnSO_4$, $MnCl_2$, $MnNO_3)_2$, $Mn(CH_3COO)_2$, $Mn(OH)_2$, $MnC_2O_4$, $MnCO_3$, $Mn_3(PO_4)_2$, MnS, MnO and $MnFe(CN)_6$.

When these manganese compounds are used, it is desirable that the concentration of $Mn^{+2}$ ion in these compounds be 1/1000 to 1/10 by mole ratio against $H_2O_2$ in an aqueous hydrogen peroxide solution.

In this invention, hydrogen peroxide is used in solution, usually at the concentration of 0.1 to 10 weight percent but the concentration is not limited to this range depending on the kind and quantity of cellulosic material to be treated.

In the case the manganese compound for use is hard to dissolve in hydrogen peroxide solution, ammonia is added to improve the dissolubility but in this invention, hydrogen peroxide solution containing a solid manganese compound which produces $Mn^{+2}$ ion in solution can be used for the treatment.

In order to treat a cellulose-containing material with hydrogen peroxide in the presence of a manganese compound by the process of this invention, the cellulose-containing material at a slurry concentration of about 1 to about 50 weight percent can be soaked in the hydrogen peroxide solution containing a manganese compound at the concentration described above.

The length of time of soaking of the cellulose-containing material in hydrogen peroxide solution containing a manganese compound as well as the temperature for the soaking depends on the kind of the cellulose-containing material to be treated and the concentration of hydrogen peroxide solution to be used, but in general, treatment at about ambient room temperature or under heating up to about the boiling point of the mixture for 30 minutes to 24 hours is sufficient. Stirring during the treatment has an effect in some cases but usually there is no need of it.

The cellulose-containing material treated as described above is hydrolyzed by enzyme as it is or after being washed, filtered, or added with catalase to decompose residual hydrogen peroxide as occasion demands.

Treatment of the cellulose by the method of this invention causes little decrease in the weight of the cellulose containing material. In other words, the weight of the treated cellulose-containing material, which has been washed further and dried, is more than 90% of the dry weight before the treatment. This fact means that the treatment by this invention is carried out under a comparatively mild condition.

Significant improvement in the hydrolysis of cellulose-containing material by enzyme by the process of this invention can be recognized from the fact that the reaction rate increases 50–100% compared with the result of the treatment with hydrogen peroxide alone as illustrated in the following examples.

The effect of this invention will now be described specifically with reference to a preferred embodiment.

EXAMPLE 1

Fibrous part of municipal waste which is sorted out and recovered in the amount of 25 g (dry matter: 25%) is disintegrated with 300 ml water by blender and filtered to make a cake which is suspended in 400 ml of 1% hydrogen peroxide solution containing 200 mg of manganese sulfate and is allowed to stand. After 16 hours, the suspension is filtered and the solid part is washed and used as described.

The susceptibility of the cellulose-containing material which is treated as described above to hydrolysis is tested in the following manner.

To the cellulose-containing material treated as described above, without drying, (the concentration is 5% as dry weight) is added dialized commercial cellulase to a concentration of 5 mg/ml (as protein), and then hydrolysis is carried out at 45° C. maintaining the pH 5.0 by addition of 0.05 M acetate buffer as needed. The hydrolysis is conducted in duplicate. Sampling is made at specific times during the reaction and the produced reducing sugar is analyzed quantitatively by the dinitrosalicylic acid method. The results are in Table 1.

TABLE 1

| | Produced reducing sugar (mg/ml) | | |
|---|---|---|---|
| Reaction time(hr) | No. 1 | No. 2 | Average |
| 3 | 20.0 | 19.8 | 19.9 |
| 9 | 26.2 | 27.0 | 26.6 |
| 24 | 33.4 | 33.5 | 33.5 |

The above example is repeated without the addition of a $Mn^{+2}$ producing compound to the pretreatment by hydrogen peroxide. The results are in Table 2.

TABLE 2

| | Produced reducing sugar (mg/ml) | | |
|---|---|---|---|
| Reaction time (hr) | No. 1 | No. 2 | Average |
| 3 | 15.9 | 16.3 | 16.1 |
| 9 | 21.6 | 21.8 | 21.7 |
| 24 | 26.4 | 27.1 | 26.8 |

As can be seen from the results of Tables 1 and 2, the rate of hydrolysis of the cellulose-containing material treated with hydrogen peroxide solution containing manganese sulfate is about two-fold of the rate of hydrolysis of the material which is pretreated by hydrogen peroxide alone.

EXAMPLE 2

Five grams of newspaper which has been milled and suspended in 100 ml. of hydrogen peroxide solution of 1% concentration containing manganese sulfate at the mole ratio of 5/100 against the hydrogen peroxide is allowed to stand in boiling water for one hour, and washed and dried.

The cellulose-containing material treated as described above is used in a substrate at 5% concentration. Hydrolysis is carried out in the same manner as in Example 1 except that the concentration of cellulase is 2 mg/ml (as protein conc.). The amount of reducing sugar resulting from 24 hour reaction is 21.5 mg/ml. For comparison, the milled newspaper is hydrolyzed by enzyme after pretreatment without manganese sulfate addition as described above. Even after 48 hours of reaction, the amount of the produced reducing sugar is merely 16.2 mg/ml.

EXAMPLE 3

In this example a comparison of susceptibility, which is observed in enzymatic hydrolysis, is made between the cellulose-containing material treated by the method of this invention using the manganese compound and the one obtained from treatment using metal compounds other than manganese.

Cellulose-containing materials are treated in the same manner as described in Example 1 using manganese sulfate and various other metal compounds as shown in Table 3 at the concentration of mole ratio 1/100 against $H_2O_2$, are dried and used as substrates, in enzymatic hydrolysis reactions in the same manner as in Example 1. After 48 hours, the amounts of produced reducing sugar are quantitatively analyzed respectively. The results are shown in Table 3.

TABLE 3

| | Metal Compound | Produced Reducing Sugar (mg/ml) |
|---|---|---|
| This Invention | $MnSO_4 . H_2O$ | 32.2 |
| Comparison | $FeSO_4 . 7H_2O$ | 22.5 |
| | $SnCl_2 . 2H_2O$ | 25.2 |
| | $Ce(SO_4)_2$ | 28.1 |
| | $NH_4VO_3$ | 27.6 |
| | $CrO_3$ | 21.5 |
| | $Cu_2Cl_2$ | 20.2 |
| | $CuCl_2 . 2H_2O$ | 21.8 |
| | $Pb(AcO)_2 . 2H_2O$ | 20.7 |
| | No addition | 27.5 |

I claim:

1. A method for treating cellulosic materials to be enzymatically converted to sugars which comprises contacting an aqueous suspension of the material with 0.1 to 10 weight percent of hydrogen peroxide in the presence of 1/10 to 1/1000 mole ratio against hydrogen peroxide of a $Mn^{+2}$ ion producing material.

2. The method of claim 1 wherein the $Mn^{+2}$ producing material is manganese sulfate.

3. The method of claim 1 wherein the cellulosic material suspension contains from about 1 to about 50 weight percent of cellulosic material.

4. The method of claim 1 wherein the contacting is carried out at from about ambient room temperature to about the boiling point of the mixture for from about 30 minutes to about 24 hours.

* * * * *